US006637169B2

(12) United States Patent
Niese et al.

(10) Patent No.: US 6,637,169 B2
(45) **Date of Patent: *Oct. 28, 2003**

(54) SLEEPER ASSEMBLY FOR RESILIENT HARDWOOD FLOOR SYSTEM

(75) Inventors: Michael W. Niese, Cincinnati, OH (US); Paul W. Elliott, Fairfield, OH (US)

(73) Assignee: Robbins, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/099,696

(22) Filed: Mar. 15, 2002

(65) Prior Publication Data

US 2002/0092255 A1 Jul. 18, 2002

Related U.S. Application Data

(63) Continuation of application No. 09/428,957, filed on Nov. 4, 1999, now Pat. No. 6,367,217.

(51) Int. Cl.[7] ..... E04B 5/14; E04B 5/43

(52) U.S. Cl. ..... 52/480; 52/403.1; 52/745.13; 52/508; 52/591.5; 52/745.05

(58) Field of Search ..... 52/480, 403.1, 52/745.05, 745.13, 745.06, 481.1, 586.1, 591.4, 591.5, 508

(56) References Cited

U.S. PATENT DOCUMENTS

| | | | |
|---|---|---|---|
| 274,354 | A | 3/1883 | McCarthy et al. |
| 498,344 | A | 5/1893 | Williams |
| 726,506 | A | 4/1903 | Capen |
| 802,622 | A | 10/1905 | Van Den Bulcke |
| 1,195,289 | A | 8/1916 | Stevens |
| 1,302,578 | A | 5/1919 | Murphy |
| 1,339,425 | A | 5/1920 | Stevens |
| 1,342,610 | A | 6/1920 | Wheeler |
| 1,343,234 | A | 6/1920 | Stevens |
| 1,350,349 | A | 8/1920 | Walther |
| 1,491,198 | A | 4/1924 | Cassidy |
| 1,587,355 | A | 1/1926 | Raun |
| 1,668,842 | A | 5/1928 | Dudfield et al. |
| 1,692,855 | A | 11/1928 | Murphy |
| 1,693,655 | A | 12/1928 | Murphy |
| 1,752,583 | A | 4/1930 | Wright |
| 1,781,117 | A | 11/1930 | Mackie et al. |
| 1,787,067 | A | 12/1930 | Eisler |

(List continued on next page.)

*Primary Examiner*—Carl D. Friedman
*Assistant Examiner*—Yvonne M. Horton
(74) *Attorney, Agent, or Firm*—Wood, Herron & Evans, L.L.P.

(57) ABSTRACT

A resilient floor includes a plurality of parallel spaced rows of sleeper assemblies, or substructure members, supported by pads over a base, with a wear layer of floorboards secured to the rows of substructure members. The substructure members include an elongated lower panel with a pair of spaced rows of pads secured along the bottom surface of the panel, and corresponding rows of nailing strips secured to the top surface of the panel, to which the wear layer is secured. The panel may also include an middle row of designations, such as holes, for locating anchors to anchor the panel to the base, if it is desired to anchor the floor. Compared to other resilient floors the substructure members of this invention simplify and reduce installation and handling time, resulting in reduced labor costs. The structure itself also provides high strength and durability, but with reduced quantity and cost of material.

26 Claims, 3 Drawing Sheets

U.S. PATENT DOCUMENTS 1,832,397 A 11/1931 Hultquist
1,911,433 A 5/1933 Cinnamond
1,977,496 A 10/1934 Snyder et al.
1,986,739 A 1/1935 Mitte
2,035,902 A 3/1936 MacLeod
2,066,005 A 12/1936 Jenkins
2,114,451 A 4/1938 Mattes
2,167,836 A 8/1939 Greulich
2,414,986 A 1/1947 Tinnerman
2,708,781 A 5/1955 McMullan
2,862,255 A * 12/1958 Nelson
2,874,603 A 2/1959 Boettcher
2,996,160 A 8/1961 Voight
3,045,294 A 7/1962 Livezey, Jr.
3,122,073 A 2/1964 Masse
3,271,916 A 9/1966 Omholt
3,387,422 A 6/1968 Wanzer
3,398,491 A 8/1968 Babcock
3,436,888 A 4/1969 Ottosson
3,511,001 A 5/1970 Morgan, Jr.
3,518,800 A 7/1970 Tank
3,553,910 A 1/1971 Hardis
3,553,919 A 1/1971 Omholt
3,554,850 A 1/1971 Kuhle
3,562,990 A 2/1971 Boettcher
3,596,422 A 8/1971 Boettcher
3,786,608 A 1/1974 Boettcher
3,788,021 A 1/1974 Husler
3,803,791 A 4/1974 Turnbull et al.
3,828,503 A 8/1974 Hofmann
4,170,859 A 10/1979 Counihan
4,586,308 A 5/1986 Jennings
4,589,243 A 5/1986 Abendroth
4,599,842 A 7/1986 Counihan
4,648,592 A 3/1987 Harinishi
4,653,246 A 3/1987 Hepler
4,703,601 A 11/1987 Abendroth
4,759,164 A 7/1988 Abendroth et al.
4,819,932 A 4/1989 Trotter, Jr.
4,831,806 A 5/1989 Niese et al.
4,856,245 A 8/1989 Osawa
4,856,250 A 8/1989 Gronau et al.
4,860,516 A 8/1989 Koller et al.
4,862,664 A 9/1989 Romine
4,879,856 A 11/1989 Jones et al.
4,879,857 A 11/1989 Peterson et al.
4,884,932 A 12/1989 Meyer
4,890,434 A 1/1990 Niese
4,910,936 A 3/1990 Abendroth et al.
4,930,280 A 6/1990 Abendroth
4,932,820 A 6/1990 Schniedermeier
5,016,413 A 5/1991 Counihan
5,359,954 A 11/1994 Kordelin
5,369,927 A 12/1994 Counihan
5,377,471 A 1/1995 Niese
5,388,380 A 2/1995 Niese
5,412,917 A 5/1995 Shelton
5,475,959 A 12/1995 Mackenzie
5,497,590 A 3/1996 Counihan
5,540,025 A 7/1996 Takehara et al.
5,609,000 A 3/1997 Niese
5,647,183 A 7/1997 Counhihan
5,682,724 A 11/1997 Randjelovic
5,727,354 A 3/1998 Clement
5,778,621 A 7/1998 Randjelovic
5,785,478 A 7/1998 Rotter
5,827,032 A 10/1998 Howard
5,906,082 A 5/1999 Counihan
6,062,789 A 5/2000 Pope
6,363,675 B1 4/2002 Shelton ..... 52/403.1
6,367,217 B1 * 4/2002 Niese et al. ..... 52/480

* cited by examiner

SLEEPER ASSEMBLY FOR RESILIENT HARDWOOD FLOOR SYSTEM

This is a continuation of presently pending U.S. application Ser. No. 09/428,957 filed on Nov. 4, 1999, now U.S. Pat. No. 6,367,217 entitled "Sleeper Assembly for Resilient Hardwood Floor System."

FIELD OF THE INVENTION

The present invention relates to floors, and more particularly, to hardwood floors having a wear layer supported over a base by compressible pads and a sleeper assembly, or substructure, which includes parallel rows of nailing strips for securing the wear layer.

BACKGROUND OF THE INVENTION

Wood floors remain popular for athletic and residential applications, for a number of reasons including aesthetics, quality, stability, ease of maintenance, durability, etc. One popular type of wood floor employs parallel rows of tongue and groove floorboards, laid end to end, across the entire floor surface.

Particularly with hardwood sports floors used primarily for athletics, such as basketball, it is desirable to provide some degree of cushioning, or impact absorption, for the upper surface of the floor relative to the base, or underlying surface. This is typically done by supporting the floorboards above the base via pads, and in most cases the floorboards are secured to the top surface of some intermediate structure, with the pads located below the intermediate structure. The use of pads in this manner creates an open air space, or air break, between the floor and the base, thereby minimizing moisture ontake by the intermediate structure or the floorboards, which are usually made of wood. If the structure does not include some mechanism for attachment to the base, the floor is said to be "free floating" relative to the base.

In some cases it is desirable to secure, or anchor, the floor to the base, primarily for stability and to minimize the potentially adverse effects of floorboard expansion and contraction which may occur as a result of moisture ontake and/or egress as humidity levels change with the seasons. Also, this moisture-caused expansion and contraction of floorboards adversely affects the performance uniformity of the floor. Thus, anchoring the floor helps to assure uniformity in performance. These dual objectives, to resiliently support the floorboards above the base and to anchor the floorboards to the base, are not easy to achieve simultaneously. Because of this situation, there have been a number of recent developments in the athletic hardwood floor industry.

More specifically, assignee's U.S. Pat. No. 5,388,380, entitled "Anchored/Resilient Sleeper for Hardwood Floor System" ("Niese '380") and issued in the name of Mike Niese, discloses several anchoring arrangements for anchoring attachment members to a base, with the attachment members supported on pads above the base and anchored in a manner which does not precompress the pads. Generally, Niese '380 relates to resiliently anchoring parallel rows of relatively narrow elongated attachment members which are spaced from each other.

Another patent of the present assignee, U.S. Pat. No. 5,609,000, entitled "Anchored/Resilient Hardwood Floor System" and also issued to Mike Niese ("Niese '000"), discloses, among other things, some variations in the intermediate structure of the floor which resides between the floorboards and the pads. These structural variations maintain the same benefits of being anchored to the base in a resilient manner, yet in a manner which does not precompress the pads, while also to some extent facilitating the manner of simultaneously achieving these objectives.

For these floors, as perhaps with all floors, there remains a high customer demand for improvements such as lower cost, shorter installation time, uniformity in performance, sufficient air flow, easier handling, and reduced quantity of materials, without any reduction in the floor's other attributes, such as being anchored and resilient but with no pad precompression, or only minimal pad precompression.

It is therefore an object of the present invention to optimally achieve these customer demands, primarily the demands for reduced costs and shorter installation time, for a floor which is anchored to a base and/or resiliently supported above a base.

SUMMARY OF THE INVENTION

The present invention achieves the above-stated objects via a floor substructure attachment member, i.e. a sleeper assembly, having an elongated lower panel with pads residing along the bottom surface, and a pair of spaced nailing strips located on the top surface of the panel along the longitudinal edges. Between the rows of top nailing strips and the bottom pads, which are preferably in rows therebelow, the member includes one or more designations, preferably predrilled holes aligned in a row, for anchoring the substructure member to a base via anchors, if desired.

The sleeper assemblies, or substructure members, are laid out end to end in spaced rows over a base, and oriented perpendicular to the orientation of the floorboard rows located thereabove. To achieve proper spacing between adjacent rows of substructure members, during installation spacers may be placed temporarily between adjacent rows of substructure members. This results in equidistant spacing of the rows of nailing strips across the entire floor, even though there are open spaces between adjacent rows of substructure members. If the rows of substructure members are to be anchored, this can be done by extending anchors through the predrilled holes and then anchoring them into the base via conventional methods. Preferably, prior to driving, a hole is drilled into the base, with drill access to the base being provided by the predrilled holes in the panel. The upper floorboards are fastened to the nailing strips, preferably by nails (or other industry standard fasteners, such as staples) driven at an angle, as is well known in the hardwood floor industry.

With this invention, due to the width of the elongated substructure members, combined with the two spaced rows of pads at the bottom of the members, the substructure members are very stable once laid in place on the base. It is virtually impossible to tip them over. Such tipping has been known to occur relatively frequently with narrow attachment members supported on only a single row of pads, a substructure commonly used for hardwood floors. Obviously, such tipping over creates delays and aggravation for installers. Such tipping also heightens the potential for misalignment of attachment members, which may lead to nonuniformity of the floors. Thus, this invention simplifies installation and eliminates unnecessary delays. Also, the rows of these substructure members are relatively easy to keep in alignment once laid in place over the base. This feature is extremely beneficial in free-floating flooring systems.

Compared to the relatively narrow attachment strips which have been commonly used, the relatively wide and flat engineered panels of these substructure members are not subject to curvature or warping from moisture. Again, once laid in place on the base, the substructure members of this invention stay in place, and stay in straight lines. By using plywood for the panels and the strips, the members can be made in lengths of up to eight feet, or even longer, but still at relatively low cost. The longer the members, the easier and more expedient the installation.

Compared to prior subfloor comprising parallel rows of narrow attachment members, this invention uses two rows of nailing strips for every one row of attachment members. Thus, the number of installed rows of the floor's intermediate structure is halved. If the substructure members are anchored, the installation requires only one row of anchors per two rows of nailing strips. Again, this represents a reduction in installation and handling time and lower labor costs, but with a high degree of stability.

This invention also reduces material costs. The panels of the substructure members may be cut from plywood, or any other suitably strong material of relatively uniform thickness. The nailing strips can also be formed of similar material, with similar thickness and length but significantly less width.

Compared to other floors, the floor of this invention achieves incredibly high stability and strength, but with significantly less material. When the floorboards are secured to the nailing strips, with the nailing strips secured to the lower panel, the combined structure has a stiffening effect similar to an "I-beam" or a structural channel. Thus, the invention achieves a high strength floor with a relatively low material cost.

According to a preferred embodiment of the invention, an anchored/resilient floor includes an upper wear layer of floorboards supported in spaced relation above a base by compressible pads, with spaced rows of substructure members residing between the pads and the wear layer. Each substructure member includes an elongated panel with a pair of spaced rows of pads secured to the bottom surface along opposite edges, and a corresponding pair of rows of nailing strips secured to the top surface, above the pad rows. The wear layer is secured by fasteners to the substructure members, via the rows of nailing strips. The rows of substructure members are spaced from each other a distance such that the rows of nailing strips are generally equidistant from each other throughout the entire floor.

The panels may also include a selected member of designations, preferably a middle row of predrilled holes, extending parallel to and residing between the two rows of nailing strips. If the substructure members are anchored, the anchors are driven into the base through the holes, preferably into holes already drilled into the base. The anchors may be configured so as to include a depth stop, or any other physical structure for preventing precompression of the pads which could otherwise result from pressurized shooting of the anchors into the base. However, compared to other substructures for anchored/resilient floors, this invention reduces the need to use a depth stop or some other depth controlling structure. This is because the pad rows are spaced away from the center row of designation holes and because the relatively thin lower panel flexes during shooting of the anchors into the base. As a result, even without a depth stop there may not be any precompression of the pads, or only negligible precompression. The anchors may include a lubricating collar, such as nylon, to prevent squeaking during relative movement between the panel and the anchor. Because the fasteners which hold the wear layer are spaced laterally away from the anchors, and also because the anchors are also spaced laterally from the pads, this inventive floor has fewer squeaks. If desired, the predrilled holes in the panel may also be somewhat elongated in the elongated direction of the substructure members, to allow some lateral movement of the floorboards.

Once installed, the heads of the anchors are spaced sufficiently from the bottom of the wear layer, i.e. the floorboards, so that downward deflection of the floorboards upon impact to the surface of the floorboards, as the pads compress, will not result in contact between the head ends of the anchors and the bottoms of the floorboards.

These and other features of the invention will be more readily understood in view of the following detailed description and the drawings.

DETAILED DESCRIPTION OF THE PREFERRED EMBODIMENT

Figure 1:
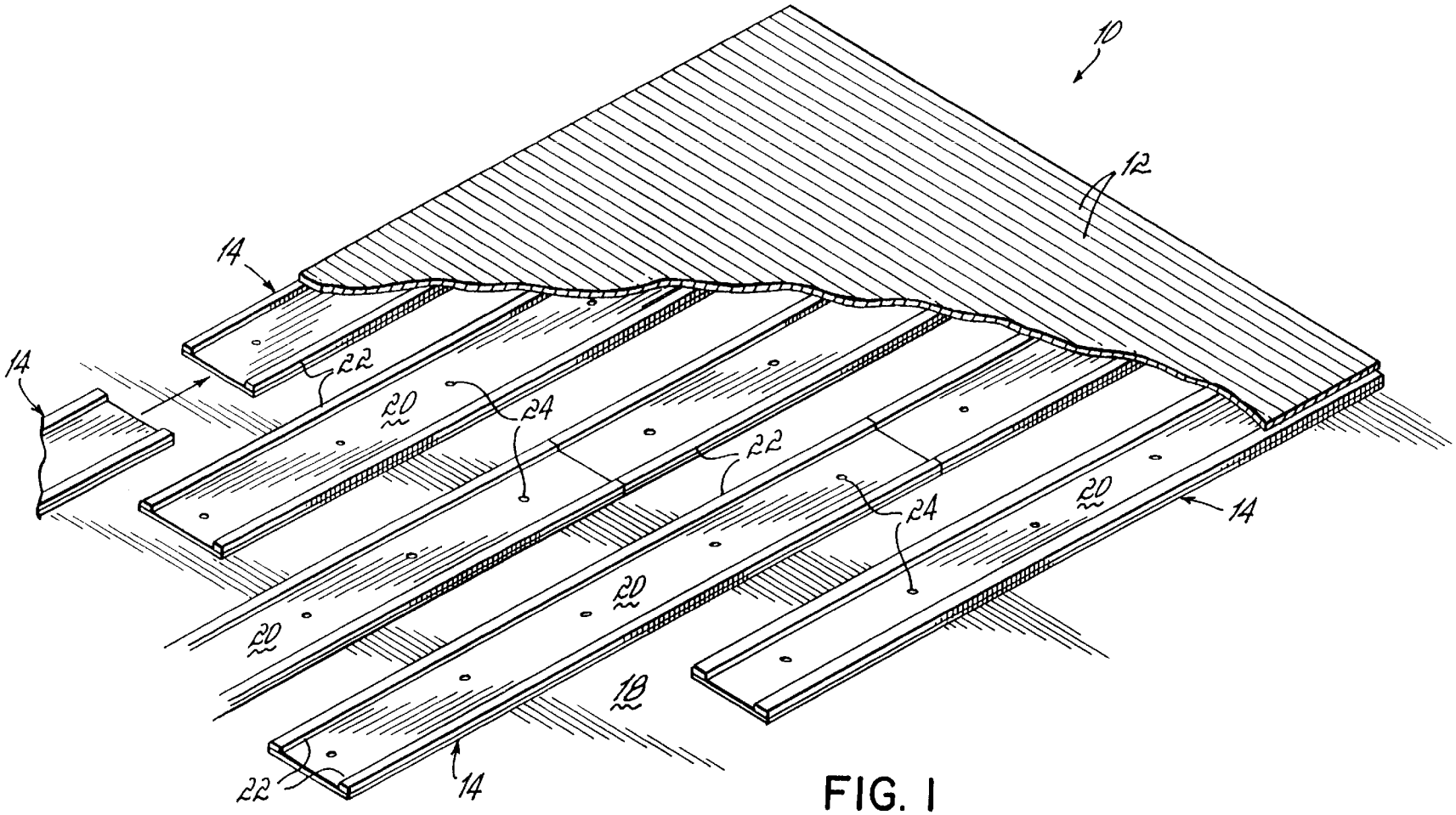
FIG. 1 is a perspective view, with a portion broken away, of a floor constructed in accordance with a first preferred embodiment of the invention.

FIG. 1 shows, in perspective view with a broken away portion, a floor 10 constructed in accordance with a first preferred embodiment of the invention. The floor 10 includes a plurality of parallel rows of floorboards 12 laid end to end, thereby to form a wear layer for the floor 10. Preferably, the floorboards 12 are tongue and groove, as is well known in the hardwood floor industry. If desired, the wear layer 12 could comprise something other than parallel rows of elongated floor boards laid end to end, such as parquet sections. In that case it may be desirable to orient the wear layer 12 differently relative to underlying components, by angling the rows of underlying components. Nevertheless, the present invention is particularly suitable for a wear layer 12 of parallel rows of floorboards.

A plurality of spaced parallel rows of sleeper assemblies, or substructure members, 14 support the floorboards 12 on a plurality pads 16 (see FIGS. 3 and 4) above a base 18. The base 18 is typically concrete, but may be any other sufficiently solid material for rigidly supporting the floor 10 thereabove. The pads 16 are preferably of EPDM rubber and compressible and deflectable, thereby to permit downward deflection of the floorboards 12 upon impact thereabove. Pads 16 which are particularly suitable for use in this invention are shown in applicant's issued U.S. Pat. No. 5,377,471 entitled "Prefabricated Sleeper for Anchored and Resilient Hardwood Floor System."

Figure 2:
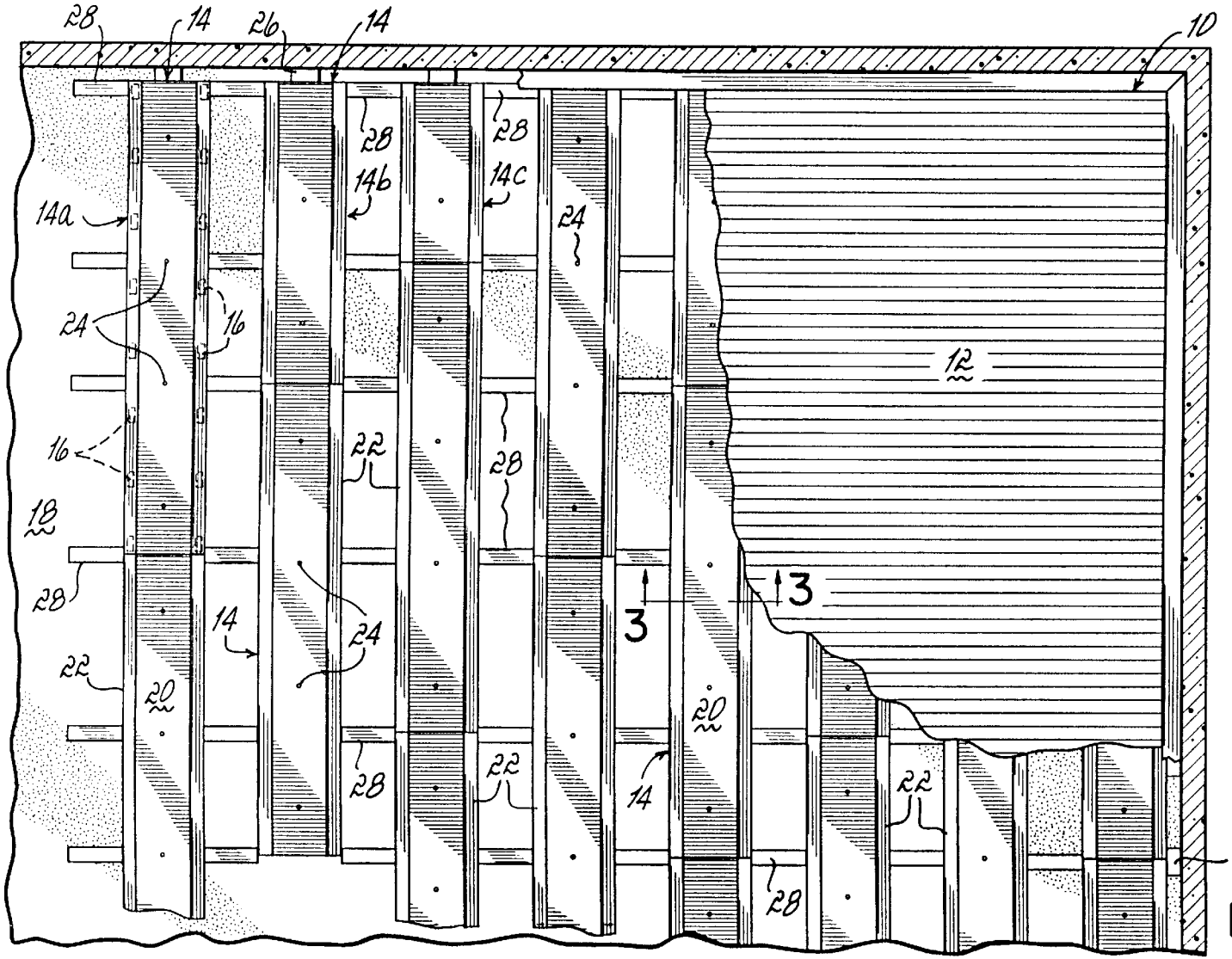
FIG. 2 is a plan view, again with a portion broken away, showing parallel rows of end to end substructure members, laid out over a base, in accordance with the first preferred embodiment of the invention.

The rows of substructure members 14 are preferably laid out so that the end joints of the members 14 are staggered, as shown in FIG. 2. The width of the substructure members 14 is preferably about 16 inches and the length of the substructure members 14 may be up to 8 feet, or even longer, although to stagger the joints of the rows of members 14 it is necessary to have at least some structure members 14 of reduced length to accommodate staggering of adjacent rows at the wall. Each of the substructure members 14 includes an elongated panel 20 and a pair of spaced parallel nailing strips 22 extending along opposite top side edges of the elongated panel 20. Preferably, the elongated panel 20 is formed from plywood, or any other suitably strong, flexible material which can be readily cut to the desired dimensions. In practice, applicant has used plywood having a width of 16 inches (406 mm) and a thickness of 15/32 inch (12 mm). The spaced nailing strips 22 are also preferably cut from plywood, with the strips 22 having a length commensurate with the panel 20, a width of preferably about 2½ inches (64 mm) and also a thickness of about 15/32 inch (12 mm), or even lower. Although it is preferable to have a one piece nailing strip 22 which extends along and is secured along the entire length of the panel 20, that is not absolutely necessary. Each strip 22 may comprise multiple strips laid end to end. Preferably, the strips 22 are secured to the panel 20, as by staples or adhesive.

Also, those skilled in the art will readily appreciate that the U-shape configuration formed by the panel 20 and the spaced strips 22 can be achieved via a number of different types of materials, different dimensions or spacing, or even achieved from a single piece of material which is cut to the desired shape. The present description and the accompanying Figures refer to only one presently preferred embodiment of the invention.

Between the rows of nailing strips 22, each panel 20 preferably includes a row of spaced designations 24 which indicate suitable locations for anchoring the substructure member 14 to the base 18. In most cases, the designations 24 will be preformed or predrilled holes formed in the panel 20 at the factory, prior to shipment to the site. However, there may be situations where the designations 24 are simply markings to indicate suitable locations for anchors. In that case, the anchors could either be driven through the panels 20 during actual anchoring, or holes could be formed in the panels 20 at the site, just prior to installation.

When the parallel rows of substructure members 14 are laid out over the base 18, they are spaced such that the parallel rows of nailing strips 22 are generally equidistant from each other across the entire base 18. This is shown in FIGS. 1 and 2, which show the layout of the rows of substructure members 14 on the base 18 prior to securement of the wear layer 12. More specifically, FIG. 2 shows end spacers 26, which are used along the ends of the rows of substructure members 14 to provide a desired distance of spacing, preferably about 2 inches, from the end wall of the room in which the floor 10 is being installed. Preferably, between the rows of substructure members 14 lateral spacers 28 are placed to enable the installers to readily obtain the correct spacing between adjacent rows of substructure members 14, so as to achieve equidistant spacing of all of the nailing strips 22. Also, as shown in FIG. 2, the substructure members 14 have three different lengths, preferably by field cutting at the site, identified by reference numerals 14*a*, 14*b* and 14*c*, to permit staggering of the end joints of adjacent rows at the end wall.

As can readily be appreciated from FIGS. 1 and 2, the floor 10 is relatively open below the wear layer 12, due to the spacing above the base 18 provided by the pads 16 and the spacing between the rows of substructure members 14. These views help to visualize that the present invention represents a reduction in the volume of material needed to provide a stable resilient floor 10 held in spaced relation above a base 18, compared to prior wood floors having a panel-type subfloor.

Also, even though the present invention may require slightly more material than required by prior floors supported on spaced rows of narrow attachment members, the present invention provides a significant cost savings over those floors because the floor of this invention is much easier to handle and install. The simplified and shortened installation time results in reduced labor costs, thereby reducing the overall cost of the floor 10.

Figure 3:
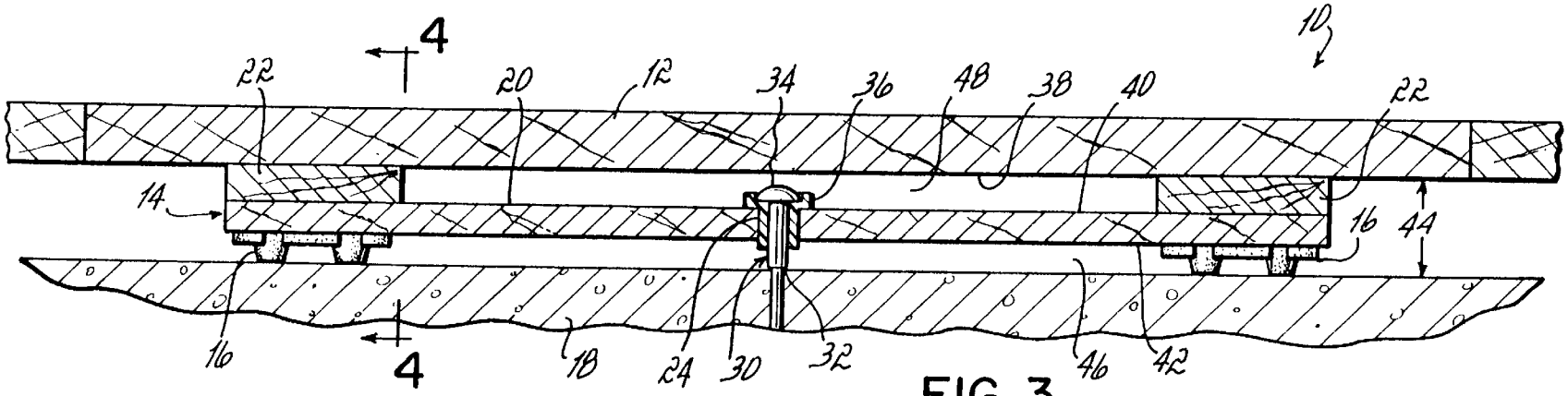
FIG. 3 is a cross sectional view taken along lines 3—3 of FIG. 2.
Figure 4:
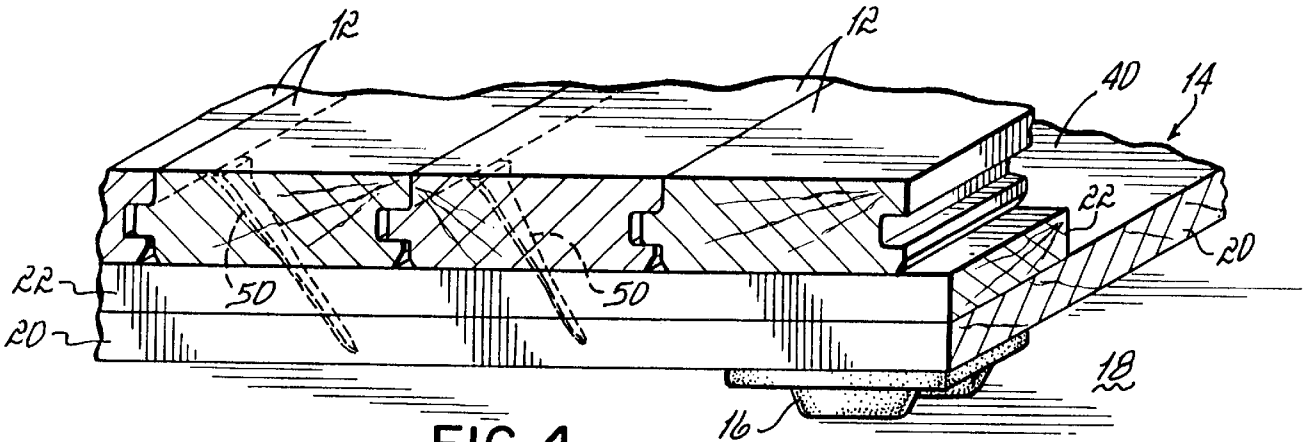
FIG. 4 is a cross sectional view taken along lines 4—4 of FIG. 3.

More specifically, because the substructure members 14 include a pair of spaced rows of pads 16 which reside below the spaced rows of nailing strips 22 (as best shown in FIGS. 3 and 4), the substructure members 14 are not susceptible to tipping over once laid out over the base 18. Moreover, because the substructure members 14 include an elongated panel 20 which has a greater width than relatively narrow attachment members, the width is sufficient to accommodate two rows of pads 16. This makes the rows of substructure members 14 relatively easy to lay out and keep in place once laid out over the base 18. Since the pads 16 are preferably already attached to the elongated panels 20, preferably by stapling the pads 16 to the panels 20 at the factory, and the nailing strips 22 are already secured to the tops of the panels 20, (again, at the factory) the substructure members 14 are shipped in "ready to install" form. At the site, they are readily laid out in spaced parallel rows over the base 18.

Although it is preferable to anchor the floor 10 of this invention, anchoring is not necessary. If the floor 10 is anchored, the anchoring occurs relatively quickly and in a simplified manner when compared to prior anchored resilient floor systems. One reason for simplified anchoring results from the use of one row of anchors 30 for every two rows of nailing strips 22, as described previously.

FIG. 3 shows a preferred embodiment for anchoring the floor 10 of the present invention. More specifically, FIG. 3 shows an anchor 30 holding the panel 20 to the base 18. The anchor 30 preferably includes a depth stop 32 which is located a predetermined distance from the head 34 of the anchor 30 so as to limit downward driving of the anchor 30, to a distance which does not provide precompression to the pads 16 during installation. Since the anchors 30 are typically driven in manually or mechanically, the depth stop 32 engages the base 18 and then limits further downward movement. As an alternative to the depth stop 32, other physical structure may be used to limit downward movement of the anchor 30 during installation. As disclosed in the previously mentioned Niese '380 and '000 patents, such other structure may be a permanent structure, or alternatively, the structure may be a temporary spacer of some sort which is held in place beneath the panel 20 during downward driving of the anchor 30, but removed after the anchor 30 is installed at the desired depth. FIG. 3 also shows a sleeve 36, which is preferably of nylon or any other suitable lubricating material, to minimize squeaking which may otherwise occur as a result of relative movement between the anchor 30 and the panel 20.

Once the attachment member 14 is anchored to the base 18, the bottom surface 38 thereof is spaced away from a top surface 40 of the substructure member 14. This spacing is sufficiently great such that the downward deflection of the floorboards 12 upon impact thereabove does not cause the bottom surface 38 to come in contact with the heads 34 of the anchor pins 30.

FIG. 3 also shows a bottom surface 42 of substructure member 14, to which the spaced rows of pads 16 are secured along opposite elongated side edges of the panel 30. FIGS. 1 and 2 show the equidistant spacing of the designations 24 relative to the rows of nailing strips 22 and the rows of pads 16. As described previously, the pads 16, the panels 20 and the nailing strips 22 support the wear layer 12 above the base 18 a desired distance, as shown by reference numeral 44. The overall structure of this floor 10 provides open space 46 below the panels 20 and open space 48 above the panels 20, and also open spacing between the spaced rows of substructure members 14, as best shown in FIGS. 1 and 2.

FIG. 4 shows the tongue and groove connection of adjacent floorboards of the wear layer 12, in accordance with the preferred embodiment of the invention. As shown, the floorboards 12 are secured to the nailing strip 22 via nails 50 which extend downwardly through the floorboards, preferably at an angle, into the nailing strip 22 and on into the panel 20.

To install the floor 10 of this invention, a suitable number of substructure members 14 and floorboards 12 are shipped to the site of installation. Each of the substructure members 14 already has a pair of spaced rows of pads 16 secured to the bottom surface 42 along side edges thereof, typically by staples (not shown) and a corresponding spaced pair of nailing strip 22 rows secured to the top surface 40 of the panel 20 above the pads 16. The nailing strips 22 may be secured to the panels 20 by adhesive or any other suitable mechanical fastener. The panels 20 also include the middle row of designations 24. The rows of substructure members 14 are laid out over the base 18, as shown in FIG. 2, with adjacently located rows being staggered via use of some shortened substructure members 14 at the end wall. Then, if the floor 10 is to be anchored, anchors 30 are driven into the base 18 via the predrilled holes located at the designations 24. Preferably, this is done by first extending a drill through predrilled holes located at the designations 24, to drill holes into the base 18. Then, anchors 30 are extended downwardly through the designation holes 24, in alignment with holes in the base, and then driven downwardly to the desired depth, which may be limited via depth stops 32 integral with the anchors 30.

The securement of the rows of substructure members 14 results in anchoring of the substructure for the floor 10, but in a resilient manner above the base 18, and also in a resilient manner which produces no precompression of the pads 18. Thereafter, the wear layer 12 is secured to the rows of substructure members 14. This is typically done by securing a plurality of parallel rows of tongue and groove floorboards, laid end to end, with the floorboards 12 secured to the spaced rows of nailing strips 22 via nails 50.

Compared to prior anchored resilient floors, the installation of the present floor 10 is a relatively simple and can be done at a lower cost. Due to the structural arrangement of the components, an anchored resilient floor 10 having minimal or no precompression of the pads can be achieved with a reduced amount of material. Even compared to other free floating hardwood floors, or other anchored floors which may have little or no resilience, the present invention represents a number of advantages to the end user, primarily due to the achievement of a uniformly stable and strong hardwood floor 10 with substantially lower installation, handling and material costs.

While this application describes one presently preferred embodiment of this invention, those skilled in the art will readily appreciate that the invention is susceptible of a number of structural variations from the particular details shown and described herein. For instance, the structure and arrangement of the pads 16, the panels 20, the nailing strips 22 and the locations of the anchors 30 may be rearranged to achieve desired effects, or perhaps reduce costs, or simplified installation. Therefore, it is to be understood that the invention in its broader aspects is not limited to the specific details of the embodiment shown and described. The embodiment shown and described is not meant to limit in any way or to restrict the scope of the appended claims.

We claim:

1. A method of installing a floor in spaced relation above a base comprising:

locating a plurality of substructure members end to end in generally parallel rows above the base to create a plurality of spaced substructure rows across the base, each of the substructure rows including a pair of spaced nailing strip rows extending along and generally parallel with the respective substructure row and a plurality of pads located below and supporting the substructure rows in spaced relation above the base, each of the substructure rows including a row of designated anchor positions extending in parallel with and between the pair of spaced nailing strip rows; and securing the substructure rows to the base at the designated anchor positions via a plurality of anchors driven into the base so as to hold the substructure rows to the base at a desired distance above the base, whereby only one single row of anchors is required to secure each pair of spaced nailing strip rows.

2. The method of claim 1 wherein the pads of the substructure rows reside in a pair of spaced pad rows which reside below the spaced nailing strip rows.

3. The method of claim 1 wherein each of the substructure members includes at least one connector that connects the pair of spaced nailing strip rows.

4. The method of claim 3 wherein the designated anchor positions are located at the connectors.

5. The method of claim 3 wherein each of the connectors comprise an elongated panel and each connector includes more than one designated anchor position.

6. The method of claim 3 wherein the designated anchor positions comprise holes formed in the connectors.

7. A method of installing a floor in spaced relation above a base comprising:

locating a plurality of substructure members end to end in generally parallel rows above the base to create a plurality of spaced substructure rows across the base, each of the substructure rows including a pair of spaced nailing strip rows extending along and generally parallel with the respective substructure row and a plurality of pads located below and supporting the substructure rows in spaced relation above the base; and securing the substructure rows to the base via a plurality of anchors driven into the base so as to hold the substructure rows to the base at a desired distance above the base, whereby only one single row of anchors is required to secure each pair of spaced nailing strip rows.

8. The method of claim 7 wherein each of the rows of anchors resides between and is generally parallel with the corresponding pair of spaced nailing strip rows.

9. The method of claim 7 wherein each of the substructure members includes at least one connector that connects the pair of spaced nailing strip rows.

10. The method of claim 9 wherein the connector comprises an elongated panels.

11. The method of claim 10 wherein an anchor of the single row of anchors extends through a hole formed in the connector with more than one anchor per end connector.

12. A method of installing a free floating floor in spaced relation above a base comprising:

locating a plurality of substructure members end to end in spaced parallel rows above the base to create a plurality of spaced substructure rows across the base, each of the substructure rows including a pair of spaced nailing strip rows secured to and extending along and generally parallel with the respective substructure row, and pads located below the nailing strip rows to support the substructure rows in spaced relation above the base, each of the substructure rows also including a plurality of connectors which extend between the respective spaced nailing strip rows, wherein the substructure rows are arranged on the base such that the nailing strip rows are spaced equidistantly across the base.

13. The method of claim 12 wherein for each substructure member the connector is a single piece, elongated panel.

14. The method of claim 13 wherein for each substructure members the spaced pair of nailing strips includes upper portions and lower portions, and the elongated panel is integral with the lower portions of the spaced nailing strip rows.

15. A free floating floor system comprising:

an upper wear layer;

a plurality of pads supporting the upper wear layer in spaced relation above a base;

a substructure residing between the pads and the upper wear layer, the substructure including a plurality of substructure members laid end-to-end in generally parallel rows above the base to define a plurality of generally parallel substructure rows, each substructure row having two spaced rows of nailing strips being generally oriented parallel with respect to the substructure rows and supported a desired distance above the base by the pads, the pads arranged in generally parallel rows located below the rows of nailing strips, the wear layer secured to the substructure rows along the nailing strips and the wear layer including parallel rows of floorboards which generally intersect the rows of nailing strips.

16. The free floating floor system of claim 15 and further comprising, for each of the substructure rows, a plurality of connectors extending between and connecting the two spaced rows of nailing strips.

17. The free floating floor of claim 16 wherein there is one connector for each substructure row, each connector comprising an elongated panel extending between the two spaced rows of nailing strips, the panels extending along the entire length of the respective substructure row.

18. The free floating floor of claim 17 wherein for each of the substructure members the spaced rows of nailing strips include upper and lower portions, and the respective elongated panel is integral with the lower portions of the spaced rows of nailing strips.

19. The free floating floor of claim 15 wherein the wear layer comprises a plurality of floorboards laid end to end in parallel rows which are oriented perpendicular to the substructure rows.

20. A free floating floor system comprising:

an upper wear layer;

a plurality of pads supporting the upper wear layer in spaced relation above a base;

a substructure residing between the pads and the upper wear layer, the substructure including a plurality of substructure members laid end-to-end in generally parallel rows, each substructure member having:

a) a panel with top and bottom surfaces, with at least some of the pads residing between the bottom surface of the panel and the base, and the top surface of the panel is spaced from the wear layer;

b) at least two spaced parallel rows of strips residing above the panel and extending generally parallel with the rows of substructure members, the wear layer secured to the substructure members along the strips.

21. The free floating floor system of claim 20 wherein for each row of substructure members, the pads are arranged in two spaced parallel rows located below the two corresponding spaced rows of strips.

22. The free floating floor system of claim 20 wherein the wear layer comprises a plurality of parallel rows of tongue and groove floorboards laid end-to-end, the floorboards secured to the substructure members by fasteners oriented at an angle, the floorboards oriented perpendicular to the substructure members and to the spaced rows of strips.

23. The free floating floor system of claim 20 wherein the strips of the substructure members are secured to the panels.

24. The free floating floor system of claim 20 wherein the panels of the substructure members comprise plywood.

25. The free floating floor system of claim 20 wherein the strips of the substructure members comprise plywood.

26. The free floating floor system of claim 20 wherein the pads are secured to the bottom surfaces of the panels of the substructure members.

* * * * *